US007270028B2

(12) United States Patent
Rixon et al.

(10) Patent No.: US 7,270,028 B2
(45) Date of Patent: Sep. 18, 2007

(54) ADJUSTABLE PEDAL ASSEMBLY WITH STEP-OVER CONTROL

(75) Inventors: Christopher Rixon, Warren, MI (US); Christopher A. Bortolon, Clawson, MI (US)

(73) Assignee: Drivesol Worldwide, Inc., Troy, MI (US)

( * ) Notice: Subject to any disclaimer, the term of this patent is extended or adjusted under 35 U.S.C. 154(b) by 649 days.

(21) Appl. No.: 10/770,877

(22) Filed: Feb. 3, 2004

(65) Prior Publication Data

US 2005/0166702 A1 Aug. 4, 2005

(51) Int. Cl.
*G05G 1/14* (2006.01)

(52) U.S. Cl. ..... 74/512

(58) Field of Classification Search ..... 74/473.17, 74/478, 512, 513
See application file for complete search history.

(56) References Cited

U.S. PATENT DOCUMENTS

| | | | | |
|---|---|---|---|---|
| 3,586,953 A | | 6/1971 | Markkanen et al. | 318/68 |
| 3,643,524 A | | 2/1972 | Herring | 74/512 |
| 3,643,525 A | * | 2/1972 | Gibas | 74/512 |
| 4,255,984 A | | 3/1981 | Abels et al. | 192/48.91 |
| 4,771,742 A | | 9/1988 | Nelson et al. | 123/90.15 |
| 4,870,871 A | * | 10/1989 | Ivan | 74/513 |
| 4,875,385 A | | 10/1989 | Sitrin | 74/512 |
| 4,989,474 A | | 2/1991 | Cicotte et al. | 74/512 |
| 5,078,024 A | | 1/1992 | Cicotte et al. | 74/512 |
| 5,086,663 A | | 2/1992 | Asano et al. | 74/512 |
| 5,127,606 A | | 7/1992 | Chan et al. | 244/54 |
| 5,161,476 A | | 11/1992 | Suzuki | 112/306 |
| 5,268,624 A | | 12/1993 | Zanger | 318/551 |
| 5,293,517 A | | 3/1994 | Andruet | 307/9.1 |
| 5,460,061 A | * | 10/1995 | Redding et al. | 74/512 |
| 5,632,183 A | | 5/1997 | Rixon et al. | 74/512 |
| 5,697,260 A | | 12/1997 | Rixon et al. | 74/514 |

(Continued)

FOREIGN PATENT DOCUMENTS

JP 7-66787 4/1995

OTHER PUBLICATIONS

Pending Patent Application entitled: "Direct Drive Adjustable Pedal System With Step-Over Control"; U.S. Appl. No. 10/457,255; filed Jun. 9, 2003.

*Primary Examiner*—Vicky A. Johnson
(74) *Attorney, Agent, or Firm*—Howard & Howard Attorneys, P.C.

(57) ABSTRACT

An adjustable pedal assembly for controlling step-over between pedal levers (16, 24) is provided. A first pedal lever (16) is supported for rotation about an operational axis. A first adjustment mechanism (20) adjusts the first pedal lever (16) between a first plurality of adjusted positions. A second pedal lever (24) is supported for rotation about a second operational axis. A second adjustment mechanism (32) adjusts the second pedal lever (24) between a second plurality of adjusted positions. First and second drives (40) simultaneously move the pedal levers (16, 24) between the adjusted positions. Linear potentiometers (56), each having a wiper (66) fixed to nut assemblies (44) of the adjustment mechanisms (20, 32), generate control signals that indicate a position of each of the pedal levers (16, 24). A controller (78) is programmed to detect a stall of either of the adjustment mechanisms (20, 32) based on the control signals to prevent step-over between the pedal levers (16, 24).

17 Claims, 4 Drawing Sheets

U.S. PATENT DOCUMENTS

| | | | | |
|---|---|---|---|---|
| 5,708,343 | A | 1/1998 | Hara et al. | 318/139 |
| 5,722,302 | A | 3/1998 | Rixon et al. | 74/512 |
| 5,819,593 | A | 10/1998 | Rixon et al. | 74/514 |
| 5,927,154 | A | 7/1999 | Elton et al. | 74/512 |
| 5,937,707 | A | 8/1999 | Rixon et al. | 74/560 |
| 5,964,125 | A | 10/1999 | Rixon et al. | 74/514 |
| 6,151,984 | A | 11/2000 | Johansson et al. | 74/512 |
| 6,151,985 | A | 11/2000 | Garber et al. | 74/512 |
| 6,189,409 | B1 * | 2/2001 | Neag et al. | 74/512 |
| 6,205,883 | B1 | 3/2001 | Bortolon | 74/512 |
| 6,247,381 | B1 | 6/2001 | Toelke et al. | 74/512 |
| 6,301,993 | B1 | 10/2001 | Orr et al. | 74/512 |
| 6,314,831 | B2 | 11/2001 | Rixon et al. | 74/512 |
| 6,352,007 | B1 | 3/2002 | Zhang et al. | 74/512 |
| 6,407,526 | B1 * | 6/2002 | Black et al. | 318/551 |
| 6,431,304 | B1 | 8/2002 | Smythe | 180/334 |
| 6,450,061 | B1 | 9/2002 | Chapman et al. | 74/512 |
| 6,510,761 | B2 | 1/2003 | Zhang et al. | 74/512 |
| 6,564,672 | B2 | 5/2003 | Brock et al. | 74/512 |
| 6,595,082 | B2 * | 7/2003 | Liimatta et al. | 74/512 |
| 6,698,309 | B2 * | 3/2004 | Rixon et al. | 74/512 |
| 6,766,713 | B2 * | 7/2004 | Sundaresan et al. | 74/512 |
| 6,810,765 | B2 * | 11/2004 | Zhang et al. | 74/512 |
| 6,916,040 | B1 * | 7/2005 | Levine | 280/735 |
| 2001/0015111 | A1 | 8/2001 | Rixon et al. | 74/512 |
| 2001/0039849 | A1 | 11/2001 | Brock et al. | 74/512 |
| 2002/0053254 | A1 | 5/2002 | Rixon et al. | 74/560 |
| 2002/0078782 | A1 | 6/2002 | Flynn | 74/512 |
| 2002/0078785 | A1 | 6/2002 | Zhang et al. | 74/512 |
| 2002/0088299 | A1 | 7/2002 | Toelke et al. | 74/512 |
| 2002/0096011 | A1 | 7/2002 | Chapman et al. | 74/512 |
| 2002/0194948 | A1 | 12/2002 | Sundaresan et al. | 74/560 |
| 2003/0005790 | A1 | 1/2003 | Liimatta et al. | 74/512 |
| 2003/0066375 | A1 * | 4/2003 | Menzies | 74/512 |
| 2003/0084705 | A1 | 5/2003 | Cui et al. | 73/1.88 |
| 2003/0121354 | A1 | 7/2003 | Rixon et al. | 74/512 |
| 2003/0121355 | A1 | 7/2003 | Rixon et al. | 74/512 |
| 2003/0121356 | A1 | 7/2003 | Rixon et al. | 74/512 |
| 2004/0244527 | A1 * | 12/2004 | Rixon et al. | 74/560 |

* cited by examiner

ADJUSTABLE PEDAL ASSEMBLY WITH STEP-OVER CONTROL

FIELD OF THE INVENTION

The present invention relates to an adjustable pedal assembly having two or more pedal levers for controlling a vehicle. More specifically, the present invention relates to the adjustable pedal assembly having sensors for controlling step-over between the pedal levers.

BACKGROUND OF THE INVENTION

Adjustable pedal assemblies are well known for use in a vehicle to provide a driver of the vehicle with a manner of adjusting a distance between the driver and pedal levers used to control the vehicle. A typical adjustable pedal assembly comprises a support for mounting the adjustable pedal assembly to the vehicle. A first pedal lever, such as an accelerator pedal lever, is supported for rotation about an operational axis relative to the support. A first adjustment mechanism adjusts the first pedal lever between a first plurality of adjusted positions relative to the support. A second pedal lever, such as a brake pedal lever, is supported for rotation about a second operational axis relative to the support. A second adjustment mechanism adjusts the second pedal lever between a second plurality of adjusted positions relative to the support. As will be appreciated by those skilled in the art, each of the first and second adjustment mechanisms typically comprise a transmission connected to a drive screw to rotate the drive screw and drive a nut axially within a guide rod. The nuts are coupled to the pedal levers to adjust the pedal levers as the nuts translate along the drive screws. A single motor is connected in series to the transmissions by a pair of rotary cables. The motor drives the transmissions to rotate the drive screws to adjust both pedal levers between the adjusted positions. Such a system is shown in U.S. Pat. No. 5,722,302 to Rixon et al. and U.S. Pat. No. 5,964,125 to Rixon et al.

As adjustable pedal assemblies have developed over the last several years, specifications concerning their use have also developed. One such specification is that of minimizing pedal lever "step-over." Step-over occurs when the first and second pedal levers become misaligned during adjustment. When the pedal levers are misaligned, the driver may have difficulty quickly adjusting to the relative positions of the first and second levers. As a result, there has come a need in the art to minimize pedal lever step-over.

A system and method for controlling pedal lever step-over in adjustable pedal assemblies are suggested in U.S. Pat. Nos. 6,352,007 and 6,510,761 to Zhang et al. In each of these patents, sensors are utilized to detect when step-over occurs between two or more pedal levers during adjustment. Specifically, hall-effect sensors are positioned adjacent to drive screws used to adjust the pedal levers to directly sense rotation of the drive screws and detect step-over. When the sensors indicate that step-over has occurred, power to a motor, which rotates the drive screws, is discontinued and adjustment of the pedal levers ceases. The hall-effect sensors disclosed in Zhang et al. do not directly sense translation of the pedal levers. Instead, the hall-effect sensors directly sense rotation of the drive screws and convert the rotational information into relative positions of the pedal levers.

A system for controlling pedal lever step-over is also shown in U.S. Pat. No. 6,450,061 to Chapman et al. The '061 patent discloses a system that integrates adjustment of two or more pedal levers into a circuit for powering a motor used to adjust the pedal levers. In this system, if the pedal levers fall out of alignment, the circuit is broken and power to the motor is discontinued. An intricate motor control switch actuated by pull cables connected to each of the pedal levers integrates adjustment of the pedal levers into the circuit. When the pedal levers do not adjust simultaneously, the pull cables actuate the switch and the switch moves to an open state. When the switch is open, the circuit is open and power to the motor is discontinued. A separate potentiometer is needed in Chapman et al. to track a position of the pedal levers for memory purposes. The potentiometer is coupled to the pull cables to sense the position of each of the pedal levers.

While prior art systems and methods have been developed for controlling step-over between pedal levers, these systems are often complicated and/or costly. There still remains a need in the art of step-over control for a simplified system that utilizes well-known, inexpensive, multi-functioning components. At the same time, there is a need for step-over control that relies on directly sensing translation of the pedal levers to minimize errors in the detection of step-over.

BRIEF SUMMARY OF THE INVENTION AND ADVANTAGES

The present invention provides an adjustable pedal assembly comprising a first support and a second support near the first support for mounting the adjustable pedal assembly to a vehicle. A first pedal lever is supported for rotation about an operational axis relative to the first support. A first adjustment mechanism adjusts the first pedal lever between a first plurality of adjusted positions relative to the first support. The first adjustment mechanism comprises a first drive and a first follower movably responsive to the first drive during operation of the first drive. The first follower is coupled to the first pedal lever to adjust the first pedal lever between the first plurality of adjusted positions. A first sensor includes a first sensing member to generate a first control signal that varies in magnitude as the first pedal lever moves between the first plurality of adjusted positions.

A second pedal lever is supported for rotation about an operational axis relative to the second support. A second adjustment mechanism adjusts the second pedal lever between a second plurality of adjusted positions relative to the second support. The second adjustment mechanism comprises a second drive and a second follower movably responsive to the second drive during operation of the second drive. The second follower is coupled to the second pedal lever to adjust the second pedal lever between the second plurality of adjusted positions. A second sensor includes a second sensing member to generate a second control signal that varies in magnitude as the second pedal lever moves between the second plurality of adjusted positions.

A controller is programmed to detect a stall of either of the adjustment mechanisms based on the control signals generated by the sensors to maintain a predetermined relationship between the pedal levers, i.e., to prevent step-over between the pedal levers. The assembly is characterized by the first sensor including a first sliding member fixed to the first follower and movable with the first pedal lever between the first plurality of adjusted positions and relative to the first sensing member to vary the magnitude of the first control signal.

The present invention provides several advantages over the prior art. Notably, the present invention provides two sensors for monitoring step-over of the pedal levers with at least the first sensor being used to directly monitor or track the first pedal lever by directly sensing translation of the first follower coupled to the first pedal lever. Furthermore, by directly sensing translation of the first follower, as opposed to directly sensing rotation of a drive screw, a greater number of mechanical failures can be detected. For instance, should threads of the first follower, e.g., nut, be stripped, the drive screw would continue to rotate without subsequent translation of the first follower and the first pedal lever. Consequently, erroneous results would occur from directly sensing rotation of the drive screw, but not when directly sensing translation of the first follower.

The first sensor also provides position memory capability for the adjustable pedal assembly. As a result, the controller can cheaply and accurately determine whether the pedal levers have fallen out of a predetermined relationship or alignment, while at the same time monitoring the actual position of each of the pedal levers, e.g., for memory purposes and the like.

BRIEF DESCRIPTION OF THE SEVERAL VIEWS OF THE DRAWINGS

Advantages of the present invention will be readily appreciated as the same becomes better understood by reference to the following detailed description when considered in connection with the accompanying drawings wherein.

DETAILED DESCRIPTION OF THE INVENTION

Referring to the Figures, wherein like numerals indicate like or corresponding parts throughout the several views, an adjustable pedal assembly is generally shown at 10. First and second supports, generally indicated at 12 and 14, are included for mounting the adjustable pedal assembly to a vehicle (not shown). The second support 14 is positioned adjacent to the first support 12. The first 12 and second 14 supports may be separate structures mounted to the vehicle. However, in the preferred embodiment, the first 12 and second 14 supports are part of a single, unitary structure mounted to the vehicle.

Figure 1:
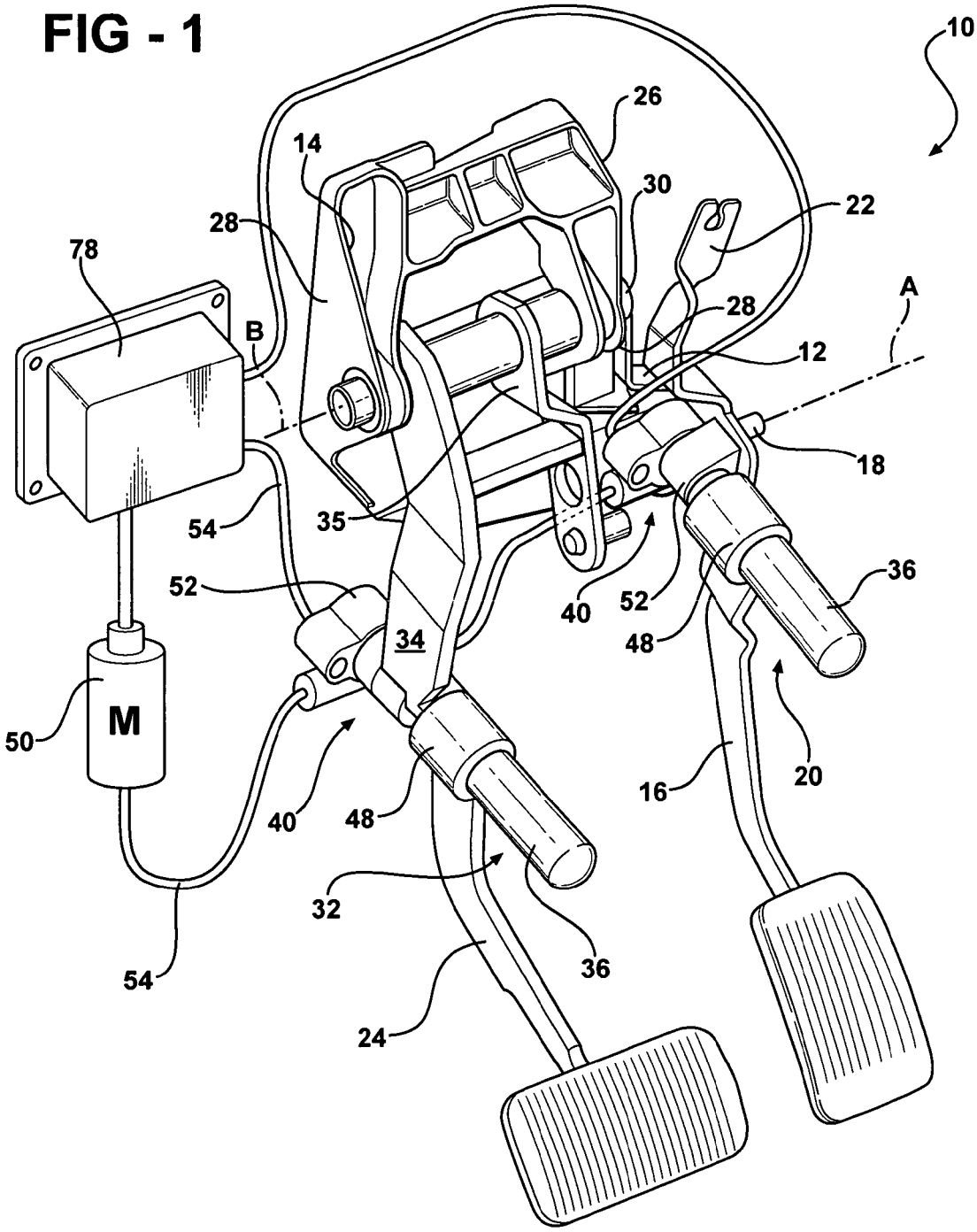
FIG. 1 is a perspective view of an adjustable pedal assembly of the present invention.

Referring to FIG. 1, a first pedal lever 16 is pivotally supported by the first support 12 for rotation about an operational axis A relative to the first support 12. A pivot shaft 18 defines the operational axis A. A cable support arm 22 is pivotal about the operational axis A upon rotation of the first pedal lever 16. The cable support arm 22 supports a cable (not shown) for connecting to a vehicle system (not shown), e.g., a throttle system of the vehicle, to operate the vehicle system. As is well known in the art, anyone of the pivot shaft 18, first pedal lever 16, and/or first support 12 could be connected to an electrical generator, e.g., a pedal position sensor such as a potentiometer, hall-effect sensor, etc., for sending a control signal to the vehicle system.

A first adjustment mechanism 20, which is also supported by the first support 12, interconnects the cable support arm 22 and the first pedal lever 16. The first adjustment mechanism 20 adjusts the first pedal lever 16 between a first plurality of adjusted positions relative to the first support 12.

A second pedal lever 24 is supported by the second support 14 for rotation about a second operational axis B relative to the second support 14. The second support 14 comprises a bracket 26 having side flanges 28 that rotatably support a second pivot shaft 30. The second pivot shaft 30 defines the second operational axis B. A second adjustment mechanism 32, which is also supported by the second support 14, is pivotally supported by the second pivot shaft 30. More specifically, the second pivot shaft 30 supports an arm 34 that supports the second adjustment mechanism 32. The second adjustment mechanism 32 interconnects the arm 34 and the second pedal lever 24 to adjust the second pedal lever 24 between a second plurality of adjusted positions.

A link 35 depends from the second pivot shaft 30 and supports an attachment (not shown) that connects to a vehicle system (not shown), e.g., a brake system, for operating the vehicle system. As is well known in the art, anyone of the second pivot shaft 30, arm 34, and/or link 35 could be connected to an electrical generator, e.g., a pedal position sensor such as a potentiometer, hall-effect sensor, etc., for sending a control signal to the vehicle system.

Figure 2:
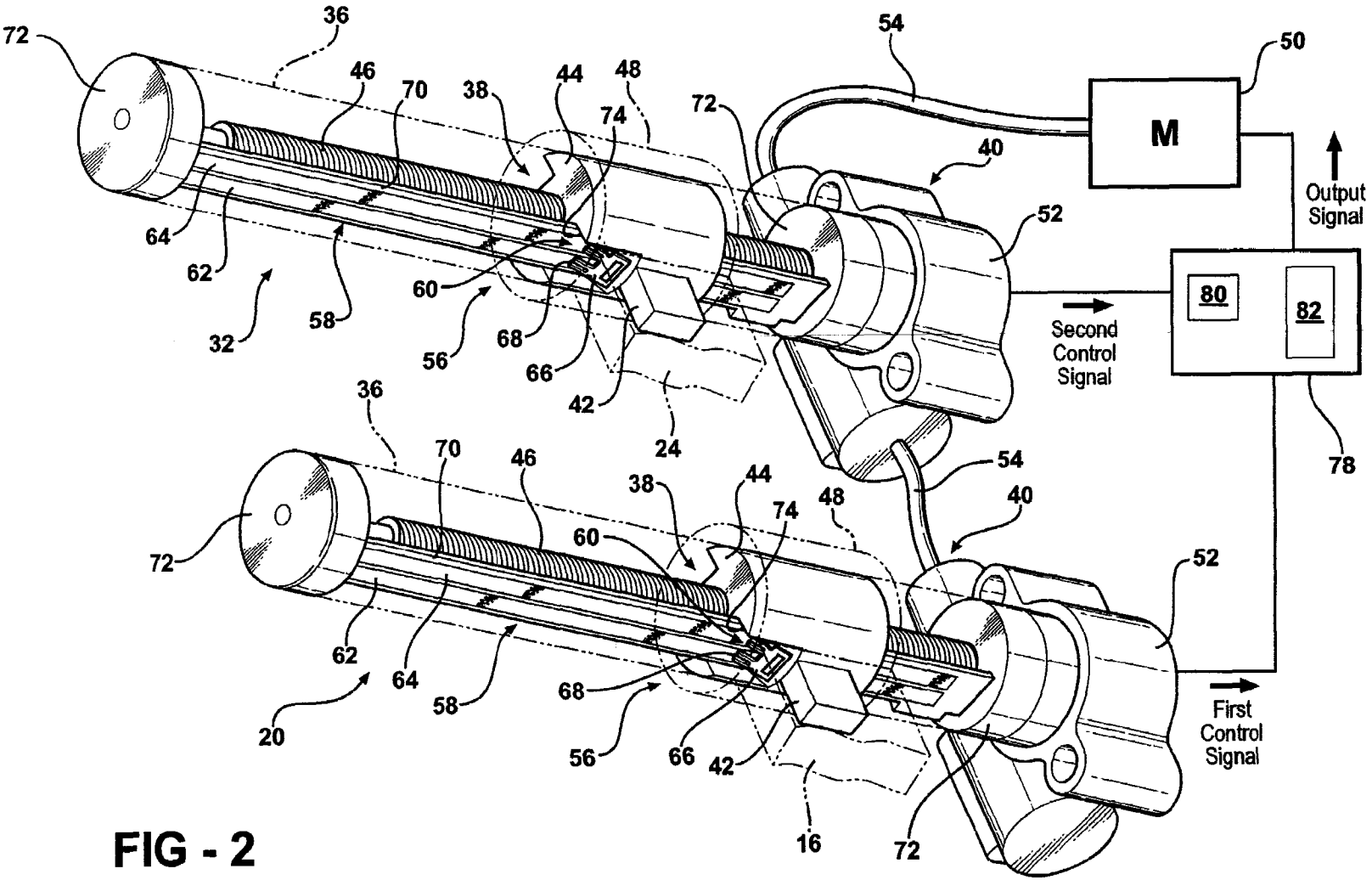
FIG. 2 is a perspective view of first and second adjustment mechanisms of the adjustable pedal assembly illustrating linear sensors thereof.

Referring to FIG. 2, each of the first 20 and second 32 adjustment mechanisms includes a guide, in the form of a guide rod 36 for supporting the pedal levers 16, 24. The guide rods 36 are hollow and each of the adjustment mechanisms 20, 32 further includes a follower 38 that translates axially within the guide rod 36 via a drive 40. For purposes of description, the first adjustment mechanism 20 includes a first follower 38 and a first drive 40 and the second adjustment mechanism 32 includes a second follower 38 and a second drive 40. The followers 38 are movably responsive to movement of the drives 40.

Keys 42 couple the followers 38 to the pedal levers 16, 24. Hence, the pedal levers 16, 24 move between the adjusted positions relative to the supports 12, 14 upon translation of the followers 38. The followers 38 are further defined as nut assemblies 44 and each of the drives 40 includes a drive screw 46 for threadably driving the nut assemblies 44. A collar 48 is slidably supported by each of the guide rods 36 to carry the pedal levers 16, 24. Each collar 48 is coupled to one of the nut assemblies 44 by way of the keys 42, as generally illustrated in U.S. Pat. No. 5,722,302 to Rixon et al. and U.S. Pat. No. 5,964,125 to Rixon et al., herein incorporated by reference. Thus, the collars 48 slide along the guide rods 36 as the drive screws 46 drive the nut assemblies 44. A bushing (not shown) is positioned between the collars 48 and the guide rods 36 to facilitate sliding of the collars 48 along the guide rods 36 while reducing pedal lash, as is well known by those skilled in the art.

In the preferred embodiment, a single motor 50 rotates the drive screws 46 of each of the adjustment mechanisms 20, 32 to adjust the pedal levers 16, 24 between the plurality of adjusted positions. Each of the drives 40 further includes a transmission 52 coupled to each of the drive screws 46 and the motor 50 is operatively connected to both of the transmissions 52 to operate the transmissions 52 and rotate the drive screws 46. Rotary cables 54 connect the motor 50 and transmissions 52 in series to drive the transmissions 52. Such a drive system and the manner in which the transmissions 52 rotate the drive screws 46 is further illustrated in U.S. Pat. No. 5,722,302 to Rixon et al. and U.S. Pat. No. 5,964,125 to Rixon et al., herein incorporated by reference.

Figure 3:
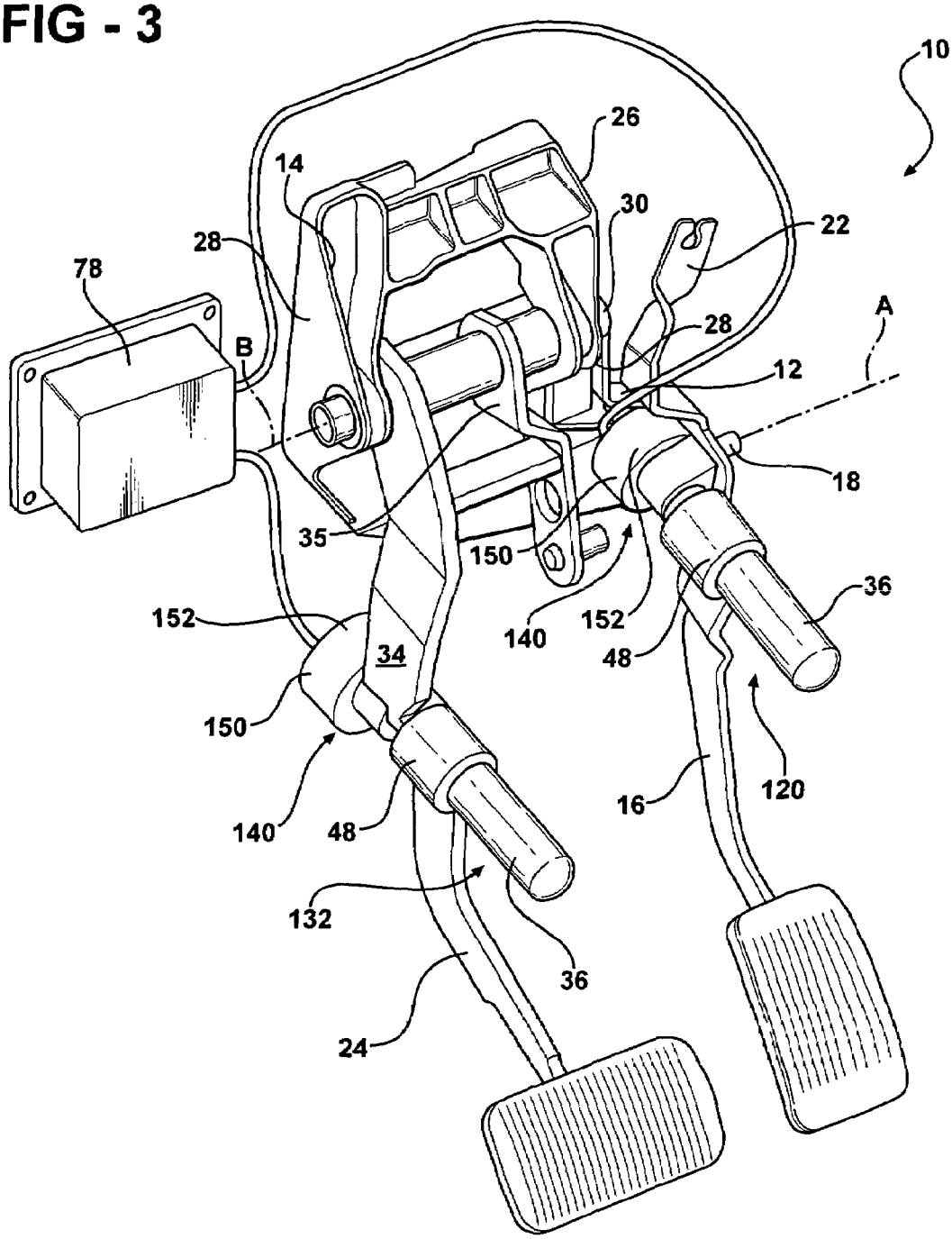
FIG. 3 is a perspective view of an alternative adjustable pedal assembly of the present invention having alternative adjustment mechanisms.

Referring to FIG. 3, alternative adjustment mechanisms 120, 132 are shown. In this embodiment, instead of utilizing the single motor 50, two transmissions 52, and rotary cables 54, the drives 140 comprise direct drive motors 150 to rotate the drive screws 46. Preferably, the motors 150 are stepper motors 150 for directly driving each of the drive screws 46. Each motor 150 includes a motor shaft (not shown) and a motor housing 152 surrounding the motor shaft. The drive screws 46 extend from the motor shafts, as opposed to extending from the transmissions 52 in the preferred embodiment. Hence, each of the motor shafts is directly connected to the drive screws 46 to rotate the drive screws 46 and threadably drive the nut assemblies 44 thereby adjusting the pedal levers 16, 24 in accordance with the preferred embodiment. The motor shafts could be directly connected to the drive screws 46 by several methods including welding, or by providing a coupling between the motor shafts and the drive screws 46. Such a connection is shown in U.S. Pat. No. 4,989,474 to Cicotte et al., herein incorporated by reference. By being directly connected, the motor shafts and drive screws 46 lie along common longitudinal axes.

Referring back to FIG. 2, a first sensor 56 is positioned near the first adjustment mechanism 20 within the guide rod 36 thereof to generate a first control signal that varies in magnitude as the first pedal lever 16 moves between the first plurality of adjusted positions. The first sensor 56 is a linear potentiometer 56 including a first sensing member 58 adjacent to the first drive 40 and a sliding member 60 fixed to the first follower 38. The first sliding member 60 is movable with the first pedal lever 16 between the first plurality of adjusted positions and relative to the first sensing member 58 to vary the magnitude of the first control signal.

A second sensor 56 is positioned near the second adjustment mechanism 32 within the guide rod 36 thereof to generate a second control signal that varies in magnitude as the second pedal lever 24 moves between the second plurality of adjusted positions. The second sensor 56 is also a linear potentiometer 56 including a second sensing member 58 adjacent to the second drive 40 and a second sliding member 60 fixed to the second follower 38. The second sliding member 60 is movable with the second pedal lever 24 between the second plurality of adjusted positions and relative to the second sensing member 58 to vary the magnitude of the second control signal.

Still referring to FIG. 2, each of the sensing members 58 includes a resistive track 62 and a conductive track 64 parallel to the resistive track 62. These electrically conductive tracks 64 are well known in the art of linear potentiometers for transmitting the control signals. Each of the sliding members 60 is further defined as a wiper 66 fixed to each of the nut assemblies 44 and in contact with both the resistive 62 and conductive 64 tracks. The wipers 66 may be snap-fit to the nut assemblies 44 or insert molded with the nut assemblies 44. The wiper 66 is slidable along both of the tracks 62, 64 upon translation of the nut assemblies 44 during adjustment of the pedal levers 16, 24. The wiper 66 is also formed from an electrically conductive material. The wiper 66 electrically connects the tracks 62, 64. The corresponding control signal varies as the wiper 66 slides along the tracks 62, 64 during adjustment of the pedal levers 16, 24, in accordance with well-known principles of linear potentiometers. Each of the wipers 66 preferably includes two or more contacts 68 in contact with each of the tracks 62, 64 to reduce erroneous readings by the sensors 56. Thus, as shown in FIG. 2, each of the sensors 56 includes at least four contacts 68 to generate the control signals.

It should be appreciated that in further embodiments, the sensors 56 may be linear variable-differential transformers (LVDTs) with the sensing member 58 being a sense winding between two excitation windings about an iron core. In this instance, the sliding member 60 is the iron core and the control signal of each sensor 56 varies as the iron core moves relative to the windings.

Each of the sensors 56 further comprises a carrier plate 70 spaced from each of the drive screws 46. The carrier plates 70 extend longitudinally along each of the drive screws 46. The tracks 62, 64 are fixed to the carrier plate 70. Preferably, the carrier plate 70 is a printed circuit board with the tracks 62, 64 embedded therein. Retainers 72 spaced from one another at opposite ends of the drive screws 46 support the carrier plates 70 within the guide rods 36 to maintain spacing between the carrier plates 70 and the drive screws 46. In the preferred embodiment, each of the nut assemblies 44 defines a channel therethrough and the carrier plates 70 slide through the channels 74 during adjustment. As a result, the tracks 62, 64 are positioned between the drive screw 46 and the wiper 66.

Figure 4:
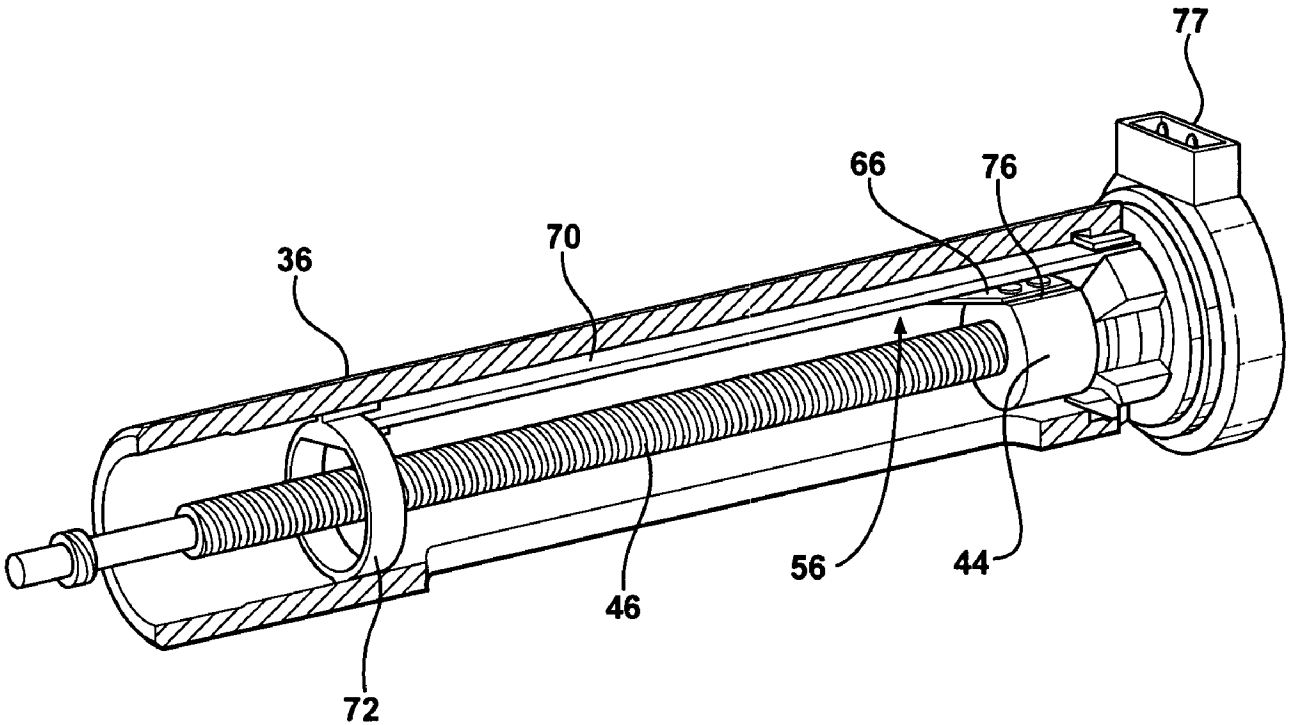
FIG. 4 is a perspective view of the first adjustment mechanism illustrating an alternative arrangement of the linear sensor.

In an alternative arrangement of the sensors 56, shown in FIG. 4, the wiper 66 is mounted to an upper surface 76 of the nut assembly 44. The tracks 62, 64 are positioned above the nut assembly 44 such that the entire nut assembly 44 is below the tracks 62, 64. The wiper 66 is angled toward the tracks 62, 64 to slide along the tracks 62, 64. An end cap 77 of each of the guide rods 36 in this embodiment is fitted with a connector to electrically connect to the sensors 56. In the preferred embodiment, the connectors are integrated into a molded housing of the transmissions 52.

Referring back to FIG. 2, a controller 78 is programmed to detect step-over between the pedal levers 16, 24. The controller 78 preferably includes a processor and memory for carrying out the functions of the controller. The controller 78 includes a comparator 80, i.e., a separate programmable component of the controller 78, or code within the controller 78, for receiving and comparing the control signals, e.g., voltage output, from the sensors 56. When the control signals are outside of a predetermined variance, step-over between the first 16 and second 24 pedal levers has occurred. In other words, the first 16 and second 24 pedal levers have fallen out of a predetermined alignment or relationship to one another. When this occurs, the controller 78 discontinues power to the motor 50 (or motors 150 in the case of the direct drive alternative of FIG. 3) via an output signal from the controller 78 that is used to energize and de-energize the motor 50 or motors 150. This discontinues movement of the drives 40 and subsequent adjustment of the pedal levers 16, 24. Thus, the controller 78 is programmed to detect a stall of either of the adjustment mechanisms 20, 32 based on the control signals generated by the sensors 56 to maintain the predetermined alignment or relationship between the pedal levers 16, 24. A stall could occur by failure of the motor 50 or motors 150, broken rotary cables 54, failure of the transmissions 52, electrical failure, or any other catalyst causing step-over of the pedal levers 16, 24. The controller 78 includes a vehicle interface 82 to integrate the controller 78 with a control system (not shown) of the vehicle.

The controller 78 may also be programmed to reset a predetermined position of the pedal levers 16, 24, such as a full-forward position, to facilitate ingress and egress of a driver of the vehicle. The controller 78 utilizes the control signals generated by the sensors 56 and signals from an ignition (not shown), and/or park switch (not shown) via the vehicle interface 82 to operate the motor 50 or motors 150 to automatically move the pedal levers 16, 24 to the full-forward position when the ignition is off and the park switch is on.

The memory of the controller 78 may also utilize signals from the ignition, the park switch, the sensors 56, and memory buttons to operate the motor 50 or motors 150 to move the pedal levers 16, 24 to a stored position in the memory when a memory button is depressed while the ignition is off and the park switch is on.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. An adjustable pedal assembly comprising;

a first support (12), a first pedal lever (16) supported by said first support (12) for rotation about an operational axis (A) relative to said first support (12), a first adjustment mechanism (20) including a first drive (40) and a first follower (38) movably responsive to said first drive (40) and coupled to said first pedal lever (16) for adjusting said first pedal lever (16) between a first plurality of adjusted positions relative to said first support (12) upon movement of said first drive (40), a first sensor (56) including a first sensing member (58) for generating a first control signal that varies in magnitude as said first pedal lever (16) moves between the first plurality of adjusted positions, a second support (14) adjacent said first support (12), a second pedal lever (24) supported by said second support (14) for rotation about a second operational axis (B) relative to said second support (14), a second adjustment mechanism (32) including a second drive (40) and a second follower (38) movably responsive to said second drive (40) and coupled to said second pedal lever (24) for adjusting said second pedal lever (24) between a second plurality of adjusted positions relative to said second support (14) upon movement of said second drive (40), a second sensor (56) including a second sensing member (58) for generating a second control signal that varies in magnitude as said second pedal lever (24) moves between the second plurality of adjusted positions, and a controller (78) programmed for detecting a stall of either of said adjustment mechanisms (20, 32) based on the control signals generated by said sensors (56) to maintain a predetermined relationship between said pedal levers (16, 24), said assembly characterized by said first sensor (56) including a first sliding member (60) fixed to said first follower (38) and movable with said first pedal lever (16) between the first plurality of adjusted positions and relative to said first sensing member (58) to vary the magnitude of the first control signal.

2. An assembly as set forth in claim 1 wherein said second sensor (56) includes a second sliding member (60) fixed to said second follower (38) and movable with said second pedal lever (24) between the second plurality of adjusted positions and relative to said second sensing member (58) to vary the magnitude of the second control signal.

3. An assembly as set forth in claim 2 wherein each of said sensing members (58) includes a resistive track (62) and a conductive track (64) parallel to said resistive track (62) and each of said sliding members (60) is further defined as a wiper (66) in contact with both of said tracks (62, 64) and longitudinally slidable along both of said tracks (62, 64) to generate the control signals.

4. An assembly as set forth in claim 3 wherein each of said wipers (66) include a pair of contacts (68) in contact with each of said tracks (62, 64).

5. An assembly as set forth in claim 3 wherein each of said drives (40) includes a drive screw (46) and each of said followers (38) are further defined as nut assemblies (44) movable along said drive screws (46) to adjust said pedal levers (16, 24).

6. An assembly as set forth in claim 5 wherein each of said drives (40) further includes a transmission (52) coupled to each of said drive screws (46) and a single motor (50) operatively connected to both of said transmissions (52) for rotating said drive screws (46).

7. An assembly as set forth in claim 5 wherein each of said sensors (56) further comprises a carrier plate (70) spaced from each of said drive screws (46) and extending longitudinally along each of said drive screws (46) with said tracks (62, 64) being fixed to said carrier plate (70).

8. An assembly as set forth in claim 7 further including a pair of retainers (72) spaced from one another along each of said drive screws (46) with each of said retainers (72) supporting said carrier plate (70) to maintain spacing between said carrier plates (70) and said drive screws (46).

9. An assembly as set forth in claim 7 wherein each of said adjustment mechanisms (20, 32) further includes a guide rod (36) surrounding each of said drive screws (46) and said carrier plates (70) wherein said pedal levers (16, 24) slide along said guide rods (36) as said pedal levers (16, 24) move between the adjusted positions.

10. An assembly as set forth in claim 1 wherein said controller (78) includes a comparator (80) for receiving the control signals from said sensors (56) and comparing the control signals whereby said controller (78) discontinues movement of said drives (40) in response to the control signals being outside a predetermined variance from one another.

11. An adjustable pedal assembly comprising:

a support (12);

a pedal lever (16) supported by said support (12) for rotation about an operational axis (A) relative to said support (12);

an adjustment mechanism (20) including a drive (40) and a follower (38) movably responsive to said drive (40), said follower (38) coupled to said pedal lever (16) for adjusting said pedal lever (16) between a plurality of adjusted positions relative to said support (12) upon operation of said drive (40); and a sensor (56) including a sensing member (58) for generating a control signal that varies in magnitude as said pedal lever (16) moves between the plurality of adjusted positions, said sensor (56) including a wiper (66) fixed to said follower (38) and movable with said pedal lever (16) between the plurality of adjusted positions and relative to said sensing member (58) to vary the magnitude of the control signal;

said assembly characterized by said sensing member (58) including a resistive track (62) and a conductive track (64) parallel to said resistive track (62) with said wiper (66) being in contact with both of said tracks (62, 64) and longitudinally slidable along both of said tracks (62, 64) to generate the control signal.

12. An assembly as set forth in claim 11 wherein said wiper (66) includes a pair of contacts (68) in contact with each of said tracks (62, 64).

13. An assembly as set forth in claim 11 wherein said drive (40) includes a drive screw (46) and said follower (38) includes a nut (44) movable along said drive screw (46) to adjust said pedal lever (16).

14. An assembly as set forth in claim 13 wherein said drive (40) further includes a motor (50) operatively connected to said drive screw (46) for rotating said drive screw (46).

15. An assembly as set forth in claim 13 wherein said sensor (56) further comprises a carrier plate (70) spaced from said drive screw (46) and extending longitudinally along said drive screw (46) with said tracks (62, 64) being fixed to said carrier plate (70).

16. An assembly as set forth in claim 15 further including a retainer (72) supporting said carrier plate (70) in spaced relation to said drive screw (46).

17. An assembly as set forth in claim 15 wherein said adjustment mechanism (20) further includes a guide rod (36) surrounding said drive screw (46) and said carrier plate (70), said pedal lever (16) slidable along said guide rod (36) as said pedal lever (16) moves between the adjusted positions.

* * * * *